US008078071B2

(12) United States Patent
Kojima et al.

(10) Patent No.: US 8,078,071 B2
(45) Date of Patent: Dec. 13, 2011

(54) IMAGE FORMING APPARATUS AND CONTROL METHOD OF THE IMAGE FORMING APPARATUS

(75) Inventors: Katsuhiro Kojima, Mishima (JP); Kenji Matsuda, Numazu (JP); Hideki Matsumoto, Utsunomiya (JP); Masaki Ojima, Mishima (JP); Minoru Matsuguma, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 1104 days.

(21) Appl. No.: 11/670,052

(22) Filed: Feb. 1, 2007

(65) Prior Publication Data

US 2007/0183802 A1 Aug. 9, 2007

(30) Foreign Application Priority Data

Feb. 3, 2006 (JP) ..... 2006-027501

(51) Int. Cl.
*G03G 15/01* (2006.01)

(52) U.S. Cl. ..... 399/54; 399/66; 399/298

(58) Field of Classification Search ..... 399/54, 399/66, 298

See application file for complete search history.

(56) References Cited

U.S. PATENT DOCUMENTS

| | | | | |
|---|---|---|---|---|
| 5,025,323 | A * | 6/1991 | Emori et al. | 358/300 |
| 5,070,367 | A * | 12/1991 | Sugano et al. | 399/54 |
| 5,353,104 | A | 10/1994 | Kato et al. | 355/259 |
| 5,519,472 | A | 5/1996 | Ojima et al. | 355/246 |
| 5,521,683 | A | 5/1996 | Miyamoto et al. | 355/246 |
| 5,570,166 | A | 10/1996 | Ohzeki et al. | 355/251 |
| 5,618,647 | A | 4/1997 | Kukimoto et al. | 430/106.6 |
| 5,678,136 | A | 10/1997 | Watanabe et al. | 399/100 |
| 5,682,585 | A | 10/1997 | Yamaguchi et al. | 399/274 |
| 5,781,835 | A | 7/1998 | Okano et al. | 399/275 |
| 5,797,070 | A * | 8/1998 | Waki et al. | 399/149 |
| 5,937,246 | A * | 8/1999 | Kaneyama | 399/228 |
| 6,047,143 | A * | 4/2000 | Larson et al. | 399/29 |
| 6,058,284 | A | 5/2000 | Okano et al. | 399/284 |
| 6,226,464 | B1 | 5/2001 | Suwa et al. | 399/27 |
| 6,226,466 | B1 | 5/2001 | Ojima et al. | 399/49 |
| 6,289,197 | B1 | 9/2001 | Matsumoto et al. | 399/281 |
| 6,343,194 | B1 * | 1/2002 | Shimada | 399/28 |
| 6,370,348 | B1 | 4/2002 | Okano et al. | 399/256 |

(Continued)

FOREIGN PATENT DOCUMENTS

JP 5-165383 7/1993

(Continued)

OTHER PUBLICATIONS

English translation of Nakane et al. (JP 2000-330354), Japanese application, published Nov. 30, 2000.*

(Continued)

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus has: a photosensitive drum onto which images are formed; and a primary transfer roller which sequentially forms the color images onto the photosensitive drum by using a plurality of developing devices having different color developers and transfers the color images formed on the drum onto a transfer member or a recording medium. Order of forming the images onto an image bearing member on a photosensitive member is switched based on a use amount of each of the plurality of developing devices.

5 Claims, 7 Drawing Sheets

| IMAGE FORMING ORDER | THE NUMBER OF PRINTS | RE-TRANSFER TONER AMOUNT (1 TIME) | RE-TRANSFER TONER AMOUNT (TOTAL) |
|---|---|---|---|
| Y | 7000 | 0.11 | 0.33 |
| M | 3500 | 0.08 | 0.16 |
| Cy | 0 | 0.06 | 0.06 |
| Bk | 7000 | 0 | 0 |

U.S. PATENT DOCUMENTS

| | | | | |
|---|---|---|---|---|
| 6,389,260 | B1 * | 5/2002 | Kataoka et al. | 399/298 |
| 6,466,759 | B1 | 10/2002 | Matsumoto | 399/274 |
| 6,496,677 | B2 * | 12/2002 | Fujimori | 399/298 |
| 6,575,096 | B1 * | 6/2003 | Caruthers et al. | 101/491 |
| 6,643,484 | B2 | 11/2003 | Kojima et al. | 399/236 |
| 6,766,121 | B2 * | 7/2004 | Nonaka et al. | 399/24 |
| 6,771,924 | B2 | 8/2004 | Matsuguma | 399/299 |
| 6,801,724 | B2 | 10/2004 | Matsumoto et al. | 399/38 |
| 6,807,384 | B2 | 10/2004 | Okubo et al. | 399/50 |
| 6,928,253 | B2 | 8/2005 | Ojima et al. | 399/129 |
| 6,963,707 | B2 | 11/2005 | Kinoshita et al. | 399/129 |
| 7,058,338 | B2 | 6/2006 | Ojima et al. | 399/149 |
| 7,242,872 | B2 * | 7/2007 | Okamoto et al. | 399/12 |
| 7,356,272 | B2 * | 4/2008 | Yamada et al. | 399/53 |
| 7,444,088 | B2 * | 10/2008 | Radulski et al. | 399/27 |
| 7,466,933 | B2 * | 12/2008 | Furukawa | 399/66 |
| 7,664,411 | B2 * | 2/2010 | Komiya | 399/38 |
| 2005/0207769 | A1 | 9/2005 | Matsuda et al. | 399/53 |
| 2006/0056867 | A1 * | 3/2006 | Taguchi | 399/49 |
| 2006/0216050 | A1 * | 9/2006 | Taguchi | 399/53 |
| 2007/0183802 | A1 | 8/2007 | Kojima et al. | 399/54 |
| 2008/0304091 | A1 * | 12/2008 | Kobashigawa | 358/1.13 |

FOREIGN PATENT DOCUMENTS

| | | | |
|---|---|---|---|
| JP | 2000-330354 | | 11/2000 |
| JP | 2005084308 | A * | 3/2005 |

OTHER PUBLICATIONS

English machine translation of Japanese document, Yunamochi (JP 2005-084308 A); published Mar. 31, 2005.*

* cited by examiner

| IMAGE FORMING ORDER | THE NUMBER OF PRINTS | RE-TRANSFER TONER AMOUNT (1 TIME) | RE-TRANSFER TONER AMOUNT (TOTAL) |
|---|---|---|---|
| Y | 7000 | 0.11 | 0.33 |
| M | 3500 | 0.08 | 0.16 |
| Cy | 0 | 0.06 | 0.06 |
| Bk | 7000 | 0 | 0 |

FIG. 8

| IMAGE FORMING ORDER | THE NUMBER OF PRINTS | RE-TRANSFER TONER AMOUNT (1 TIME) | RE-TRANSFER TONER AMOUNT (TOTAL) |
|---|---|---|---|
| Cy | 0 | 0.06 | 0.18 |
| M | 3500 | 0.08 | 0.16 |
| Y | 7000 | 0.11 | 0.11 |
| Bk | 7000 | 0 | 0 |

FIG. 9

| TONER WEIGHT (g) | CONSTANT T |
|---|---|
| 300—200 | 1 |
| 200—150 | 1.1 |
| 150—100 | 1.2 |
| 100—60 | 1.3 |
| 60—40 | 1.4 |
| 40—20 | 1.5 |
| 20—10 | 1.7 |
| 10—0 | 2 |

FIG. 12

| COLOR | THE NUMBER OF PRINTS | PRINT RATIO | INDEX VALUE OF EXTERNAL ADDITIVE AGENT DECREASE AMOUNT A | IMAGE FORMING ORDER | RE-TRANSFER TONER AMOUNT (1 TIME) | RE-TRANSFER TONER AMOUNT (TOTAL) |
|---|---|---|---|---|---|---|
| Y | 12000 | 2.50% | 13600 | 2 | 0.15 | 0.3 |
| M | 9000 | 5.00% | 15200 | 3 | 0.18 | 0.18 |
| C | 12000 | 2.50% | 13600 | 1 | 0.15 | 0.45 |
| Bk | 9000 | 5.00% | 15200 | 4 | 0.18 | 0 |

FIG. 13

| COLOR | THE NUMBER OF PRINTS | PRINT RATIO | INDEX VALUE OF EXTERNAL ADDITIVE AGENT DECREASE AMOUNT A | IMAGE FORMING ORDER | RE-TRANSFER TONER AMOUNT (1 TIME) | RE-TRANSFER TONER AMOUNT (TOTAL) |
|---|---|---|---|---|---|---|
| Y | 12000 | 2.50% | 13600 | 3 | 0.15 | 0.15 |
| M | 9000 | 5.00% | 15200 | 1 | 0.18 | 0.54 |
| C | 12000 | 2.50% | 13600 | 4 | 0.15 | 0 |
| Bk | 9000 | 5.00% | 15200 | 2 | 0.18 | 0.36 |

IMAGE FORMING APPARATUS AND CONTROL METHOD OF THE IMAGE FORMING APPARATUS

BACKGROUND OF THE INVENTION

1. Field of the Invention

The present invention relates to an image forming apparatus which can change an image forming order and a control method of the image forming apparatus.

2. Description of the Related Art

In an image forming apparatus for forming a color image onto a transfer member by overlaying toner images of a plurality of colors, there is a method whereby electrostatic latent images are formed onto an image bearing member, sequentially developed by toner, and transferred onto the transfer member every development, and the color toner images of a plurality of colors are overlaid. There is also a method whereby a plurality of toner images are overlaid onto an intermediate transfer member and transferred onto the transfer member in a lump. However, in both of the methods, such a phenomenon that the toner transferred onto the transfer member or the intermediate transfer member is transported onto a photosensitive member (hereinafter, referred to as a re-transfer phenomenon) occurs.

The re-transfer phenomenon occurs by the following reason: the toner whose charged charge amount is small among the transferred toner or the toner which has been charged to an opposite charge by an influence of a discharge phenomenon or a transfer current at an image transfer position (also referred to as a transfer nip) is transported onto the photosensitive member by an electrostatic force, a van der Waals force, and the like.

An adverse influence on the image by the re-transfer phenomenon is enhanced with an increase in use amount (the number of prints, a driving time of a developer holding member, etc.) of a developing apparatus. It is presumed that this is because when the use amount of the developing apparatus increases, the charged charge amount of the toner decreases by a change (particularly, deterioration) in surface state or the like of each of a developing roller, a developing blade, and the toner.

An adverse influence on the image by the re-transfer phenomenon is caused so that the external additive agent may be buried under the toner, and the external additive agent may separate from the toner moreover.

For example, in the conventional image forming apparatus, a technique for reducing the adverse influence on the image exists.

For example, there is a method whereby concentration data of all pixels of one page of an original document is accumulated from original document image data of every reproduction color (every color of yellow, magenta, cyan, and black) and images are sequentially formed in ascending order from the color of the small accumulation value (for example, refer to Japanese Patent Application Laid-Open No. 2000-330354). According to such a method, the influence of the re-transfer phenomenon can be reduced. Its reasons will now be described. For example, the toner which has first been transferred from the photosensitive member onto the transfer member or a recording medium has three opportunities for re-transfer to occur. The toner which has finally been transferred from the photosensitive member onto the transfer member or the recording medium does not have the opportunity for the re-transfer phenomenon to occur. That is, the number of opportunities for the re-transfer phenomenon to occur is larger when the image forming order is earlier. Therefore, by forming the images in order from the image in which an amount of toner that is transferred onto the transfer member or the recording medium is small, the influence by the re-transfer phenomenon can be reduced.

There has also been known a method whereby by removing the charges on the surface of the photosensitive member before the photosensitive member enters the transfer nip, a potential difference between the photosensitive member surface and an intermediate transfer belt or the transfer member is decreased, the transfer current and the discharge amount in the transfer nip are reduced, and an amount of reversely-charged toner is decreased, thereby preventing the re-transfer. For example, refer to Japanese Patent Application Laid-Open No. H05-165383.

However, in the related art, there are the following problems. According to the invention disclosed in Japanese Patent Application Laid-Open No. 2000-330354, the images are sequentially formed in ascending order from the color of the small accumulation value of the concentration data of all pixels. However, if the use amount of the developing apparatus which first forms the image is large, there is a case of occurrence of the adverse influence on the image by the re-transfer. The foregoing adverse influence on the image is typical when an image in which the image data has locally been concentrated is printed.

According to Japanese Patent Application Laid-Open No. H05-165383, although the re-transfer phenomenon can be remarkably reduced by exposure of the photosensitive member before the transfer, another adverse influence on the image such as scattering caused by the exposure before the transfer, deterioration in dot reproducibility, or the like occurs.

The invention is made in consideration of the above problems and it is an object of the invention to provide an image forming apparatus in which by changing image forming order according to a use situation of a developing device, a re-transfer phenomenon of toner is reduced without causing scattering and deterioration in dot reproducibility and to provide a control method of the image forming apparatus.

SUMMARY OF THE INVENTION

It is an object of the invention to provide an image forming apparatus comprising: an image bearing member onto which images are formed; a transfer unit which sequentially forms the images of respective colors onto the image bearing member by using a plurality of developing devices having developers of the different colors and transfers the images of the colors formed on the image bearing member onto a transfer member or a recording medium; and a control unit which switches the order of forming the images onto the image bearing member by using the plurality of developing devices based on a use amount of each of the plurality of developing devices.

Another object of the invention is to provide a control method of an image forming apparatus having a first image forming mode in which images of respective colors are sequentially formed onto an image bearing member in a first order by using a plurality of developing devices having developers of the different colors and the images of the colors formed on the image bearing member are transferred onto a transfer member or a recording medium. In addition, there is a second image forming mode in which the images of the colors are sequentially formed onto the image bearing member in an order different from the first order and the images of the colors formed on the image bearing member are transferred onto the transfer member or the recording medium.

The method includes detecting a use amount of each of the plurality of developing devices; and controlling so as to switch from the first image forming mode to the second image forming mode according to the detected use amount of each of the plurality of developing devices.

Further features of the present invention will become apparent from the following description of exemplary embodiments with reference to the attached drawings.

BRIEF DESCRIPTION OF THE DRAWINGS

FIG. 8 is a diagram showing the re-transfer toner amount in the case where image forming color order is changed in the embodiment 1.

FIG. 9 is a diagram showing a correlation between a toner amount and a constant T in an embodiment 2.

FIG. 12 is a diagram showing a re-transfer toner amount of each developing cartridge in the embodiment 2.

FIG. 13 is a diagram showing a re-transfer toner amount in the case where images are formed in order of the number of prints in the embodiment 2.

DESCRIPTION OF THE EMBODIMENTS

Exemplary embodiments of the invention will now be described in more detail with respect to embodiments.

Embodiment 1

The first embodiment of an image forming apparatus according to the invention will be described. First, a whole construction of the image forming apparatus will be described with reference to FIG. 1. The image forming apparatus illustrated in FIG. 1 is a color printer using an electro photographic system and an intermediate transfer system.

Figure 1:
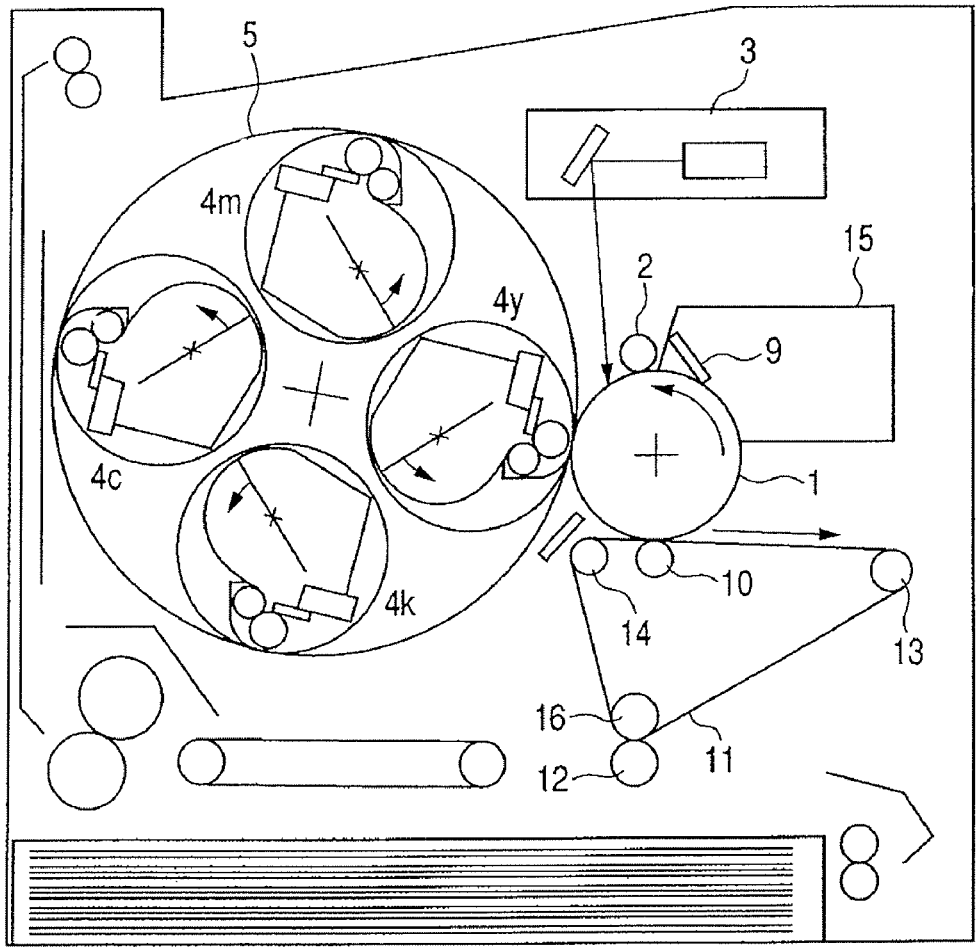
FIG. 1 is an explanatory diagram of a whole construction illustrating an image forming apparatus of an embodiment 1.

The image forming apparatus of FIG. 1 has a photosensitive member 1 as an image bearing member and is rotated in the direction shown by an arrow. Minus charges are applied to the surface of the photosensitive member 1 by a charging roller 2 and the surface is uniformly charged to −600V. An exposure optical system 3 irradiates scanning light whose light emission has been controlled based on image data onto the surface of the photosensitive member 1 and removes the minus charges, thereby forming a latent image. An electric potential of the latent image portion is equal to about −100V. The latent image is developed by developing devices (hereinafter, referred to as developing cartridges) 4*y*, 4*m*, 4*c*, and 4*k* of respective colors in order determined by use amount of the developing cartridges. The developing cartridges 4*y*, 4*m*, 4*c*, and 4*k* contain toner as developers of the yellow, magenta, cyan, and black colors and are attached to a rotary 5. Each time the rotary 5 rotates by 90°, a corresponding one of the developing cartridges 4*y*, 4*m*, 4*c*, and 4*k* faces the photosensitive member 1 and develops the latent image on the photosensitive member 1 by the toner of the corresponding color. The toner is made by: a toner host material containing a binder resin, a coloring agent, a charge control material, and the like; and an external additive agent which is externally added and mixed to the host material. Toner of one non-magnetic component is used as toner. FIG. 1 illustrates a state where the yellow developing cartridge 4*y* has been arranged at a developing position.

Figure 2:
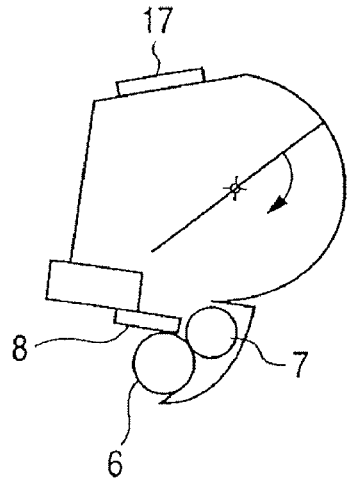
FIG. 2 is a schematic cross sectional view illustrating a developing cartridge in the embodiment 1.

The developing cartridge will now be described with reference to FIG. 2. The developing cartridge is formed by integrating a developing roller 6 which holds the developer, a toner supplying roller 7, a developing blade 8, and the like into one unit. The developing cartridge is detachably provided for the image forming apparatus main body. A storing unit 17 which can store various kinds of information is built in the developing cartridge.

The data writing and reading operations to/from the storing unit 17 are executed by a signal processing unit provided for the image forming apparatus main body. Use amount information such as the number of prints, accumulated time of a developing roller driving time, and the like from the initial using time of the developing cartridge has been stored in the storing unit 17.

A predetermined amount of toner charged to a negative polarity has been supplied onto the developing roller 6 which faces the photosensitive member 1. A developing bias has been applied to the developing roller 6 by a power source (not shown). As a developing bias, by setting a potential difference between a charging electric potential and a latent image (exposing portion) electric potential to a proper value, a stable print image is obtained irrespective of an environment and a using situation of the developing cartridge.

After that, in a primary transfer nip portion as a primary transfer position, the toner images developed on the photosensitive member 1 are sequentially primary-transferred onto an intermediate transfer belt 11 as an intermediate transfer member. The intermediate transfer belt 11 is suspended by a roller 16 arranged so as to face a secondary transfer roller 12, a driving roller 13, and a tension roller 14 and rotates in the direction shown by an arrow at substantially the same speed as that of the photosensitive member 1. As an intermediate transfer belt 11, generally, a resin film belt having a thickness of 50 to 300 μm and volume resistivity of about $10^{-12}$ to $10^{-7}$ Ωcm and made of PVDF, polyamide, polyimide, PET, nylon, polycarbonate, or the like can be used. A rubber belt obtained by forming a resin layer having a thickness of tens of μm, high mold release performance, and a high resistance onto a rubber base layer having a thickness of about 0.5 to 2 mm and a low resistance or the like can be also used. A resistance value of the intermediate transfer belt 11 can be adjusted by a conductive filling material made of carbon, ZnO, $SnO_2$, $TiO_2$, or the like. A primary transfer bias of a plus polarity has been applied to a primary transfer roller 10 by the power source. A primary transfer bias value is constant-voltage controlled. A value of a voltage which is applied upon image creation is determined by a method whereby a primary transfer voltage value at which a desired primary transfer current value is obtained is detected before the transfer operation in consideration of a resistance fluctuation of the primary transfer roller 10 and the intermediate transfer belt 11 that is caused by the factors such as environment and using situation.

The primary transfer residual toner remaining on the surface of the photosensitive member after the primary transfer process is removed by a cleaning blade 9 having an elastic blade and enclosed into a drain toner container 15.

When a full color image or a monochromatic image is formed onto the intermediate transfer belt 11 by the primary transfer, in a secondary transfer nip portion as a secondary transfer position, the secondary transfer roller 12 comes into contact with the transfer member. The images are secondary-transferred in a lump onto the transfer member by the applied bias (+1 kv) having the plus polarity. The transfer member which holds the toner images of the four colors on the surface through the secondary transfer is conveyed to the fixing device. The toner images on the surface are fixed by the fixing device and the image forming process is completed.

A mechanism of the re-transfer phenomenon will now be described.

Figure 3:
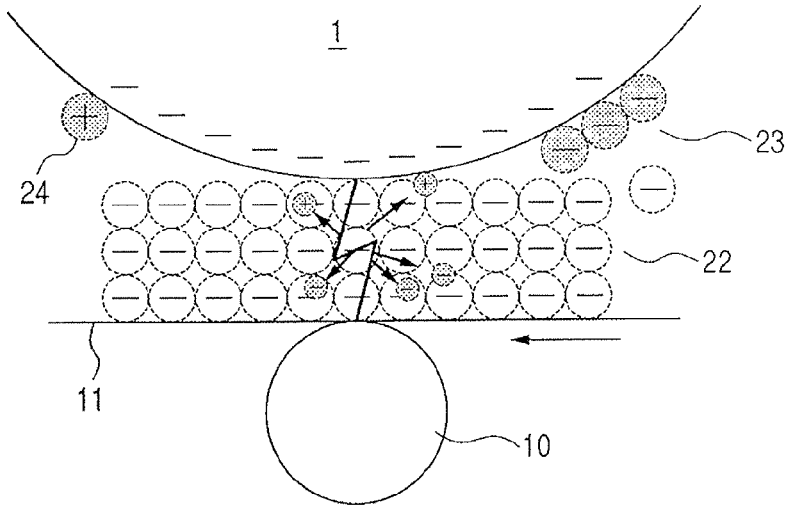
FIG. 3 is a schematic diagram of an occurrence mechanism of re-transfer.

FIG. 3 is an enlarged explanatory diagram of the primary transfer nip portion. The re-transfer phenomenon will be described with reference to FIG. 3. Fundamentally, it is assumed that the images are formed in order of yellow, magenta, cyan, and black. The yellow toner image transferred to the intermediate transfer belt has a possibility that the re-transfer phenomenon occurs in the primary transfer process (magenta, cyan, black). FIG. 3 will be described with respect to the case where the transfer process of, for example, magenta toner 23 is executed. In the primary transfer process of the magenta toner, a part of yellow toner 22 on the intermediate transfer belt is transported to the photosensitive member 1. This transported toner 24 is called "re-transfer toner". It is considered that the re-transfer phenomenon occurs because the toner of the positive polarity and the toner of the weak negative polarity are transported to the photosensitive member 1 by the electrostatic force, van der Waals force, and the like It is considered that the re-transfer is (1) the toner whose charged charge amount is small in the yellow toner 22 on the intermediate transfer belt and (2) the toner whose charged charge amount has been decreased by a discharge or a transfer current at the transfer nip position or which has been charged to the opposite charges.

Figure 4:
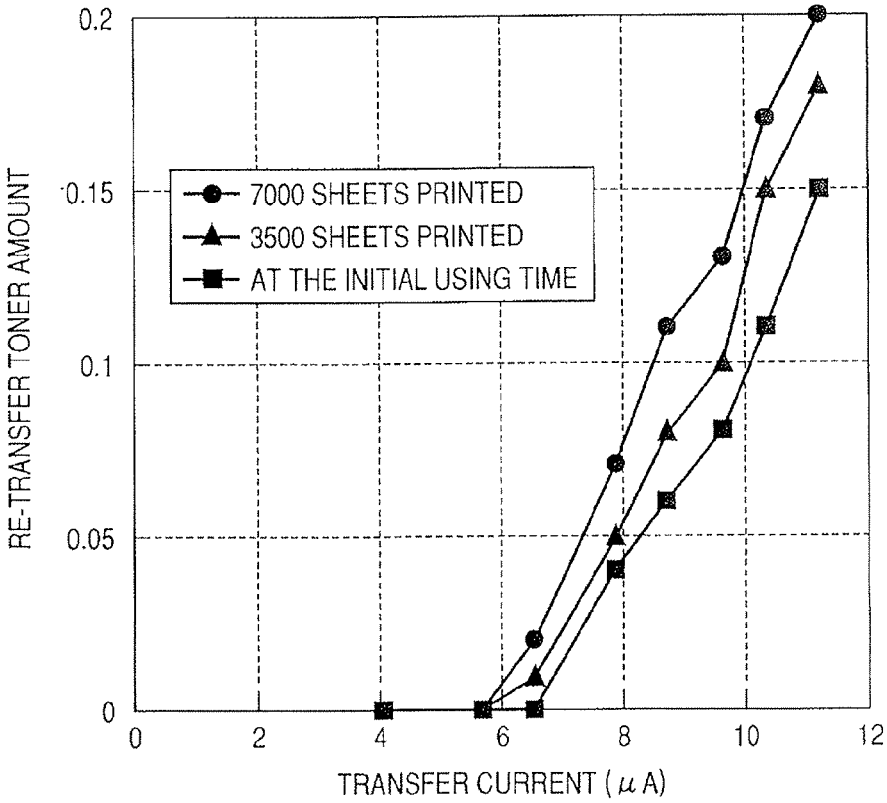
FIG. 4 is a diagram illustrating dependency of a re-transfer toner amount on a transfer current in the embodiment 1.

FIG. 4 illustrates dependency of a re-transfer toner amount on the transfer current in each of the initial using state, the developing cartridge which has printed 3500 prints (5% printing), and the developing cartridge which has printed 7000 prints (5% printing).

A measuring method of the re-transfer toner amount will be described here. While the primary transfer process of the second color (magenta) is being executed, the power source of the image forming apparatus main body is turned off. The re-transfer toner in which a part of the yellow toner on the intermediate transfer belt was transported to the photosensitive member 1 has been transported to the photosensitive member 1. The re-transfer toner is transferred onto an adhesive tape and deposited to white recording paper. A reflection concentration (Macbeth concentration) of the tape is subtracted from a reflection concentration (Macbeth concentration) of a reference tape that does not adhere toner and a result is used as a re-transfer toner amount.

If the transfer currents of all three kinds of developing cartridges are increased (that is, the transfer biases are increased), the re-transfer toner amount increases. It is presumed that this occurs because when the transfer voltage is increased, the discharge amount and the transfer current in the transfer nip increase.

A result in which the re-transfer toner amount increases with an increase in the number of prints is obtained. It is presumed that this occurs because when the use amount (the number of prints, driving time of the developer holding member, and the like) of the developing apparatus increases, the charged charge amount of the toner decreases by a change (particularly, deterioration) in the surface states of the developing roller, developing blade, and toner or the like. Among them, it is presumed that, particularly, an influence by liberation and embedding of the external additive agent from/into the toner surface due to the friction by the developing roller, developing blade, or the like is large.

As a target value of the re-transfer toner amount of each color, 0.2 or less is preferable as a total re-transfer amount. The total re-transfer amount is a total value of the re-transfer toner amount (Macbeth concentration) of three times in the case of the first color and is a total value of the re-transfer toner amount (Macbeth concentration) of two times in the case of the second color.

The primary transfer current at the time of the actual image creation is equal to 8.7 μA. If the transfer current is equal to 8.7 μA, when 7000 sheets are printed, the re-transfer toner amount in one transfer process is equal to 0.11. When the re-transfer is executed three times, the re-transfer toner amount is equal to about 0.33. Therefore, this value is fairly larger than 0.2 as a target value. In the embodiment, therefore, the re-transfer toner amount is decreased by sequentially executing the image creation in order from the developing cartridge whose use amount is smaller.

A determining method of the image forming order will now be described. It is considered that if print ratios of all colors are almost equal, the decrease in external additive agent on the toner surface existing in the developing cartridge depends on the total number of prints. Therefore, in the embodiment, the images are formed in order from the developing cartridge in which the total number of prints from the initial using time is larger.

The printing operation in the embodiment will be described hereinbelow with reference to FIGS. 5 and 6.

Figure 5:
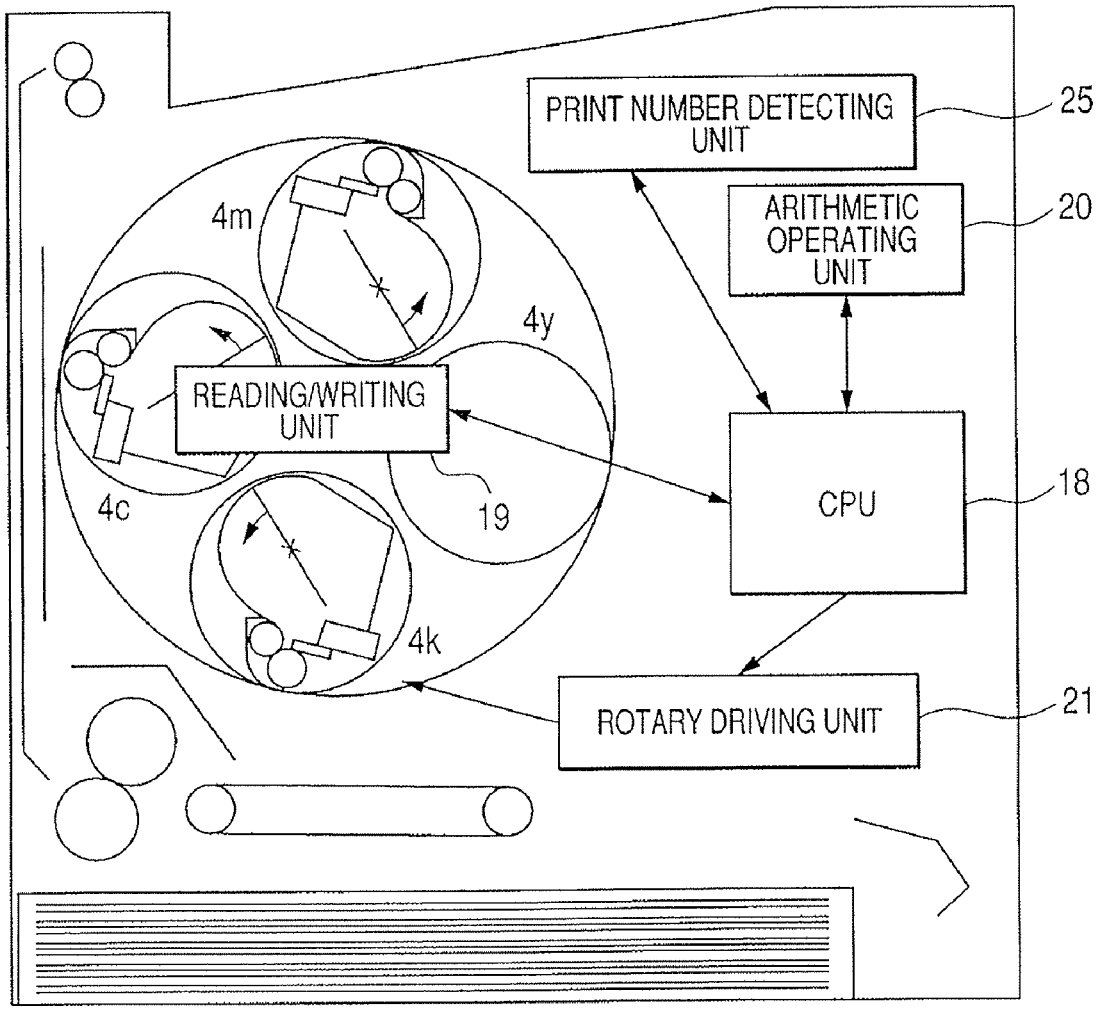
FIG. 5 is a block diagram illustrating a control system in the embodiment 1.
Figures 6, 7:
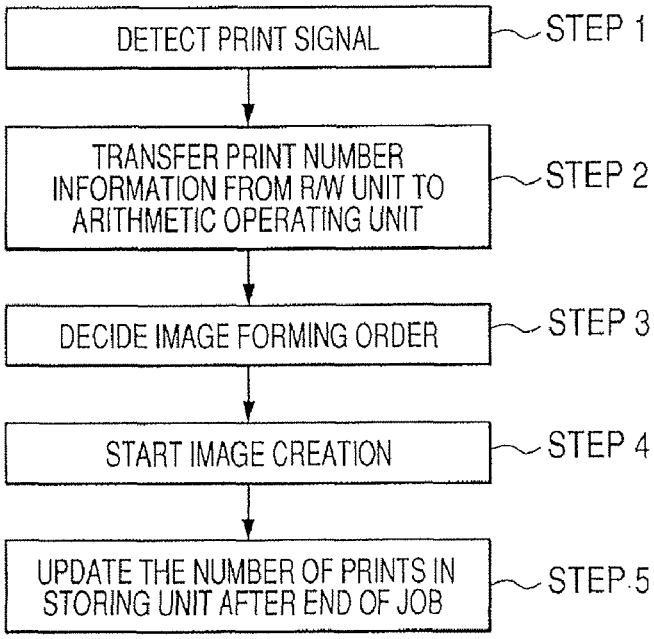
FIG. 6 is a flowchart for the printing operation in the embodiment 1.
FIG. 7 is a diagram showing the re-transfer toner amount in the case where image forming color order is not changed in the embodiment 1.

FIG. 5 is a block diagram illustrating a control system in the embodiment 1. FIG. 6 is a flowchart for the image creation in the embodiment 1.

The image forming apparatus detects a print signal (step 1).

The image forming apparatus main body has a reading unit for reading print number information (showing the number of prints) stored in the storing unit of the developing cartridge. A CPU 18 of the image forming apparatus transfers the print number information of the developing apparatus stored in the storing unit of the developing device from a reading/writing unit (also referred to as an R/W unit) 19 of the image forming apparatus main body to an arithmetic operating unit 20 (step 2).

The arithmetic operating unit 20 determines the order of executing the image forming operation from the number of prints read out of the storing unit of each developing cartridge (step 3).

The CPU 18 forms the images in the order determined by the arithmetic operating unit 20 by controlling a driving unit 21 of the rotary 5. By rotating the photosensitive member, the image forming operation is started in the order determined in step 3 (step 4).

After completion of a job, the number of prints of each developing cartridge detected by a print number detecting unit 25 is written into the storing unit 17 of the developing cartridge and the number of prints is updated (step 5).

For example, a case where the use amounts of the developing cartridges are equal to 7000 prints (yellow), 3500 prints (magenta), 0 print (that is, new cartridge; cyan), and 7000 prints (black) will now be considered. FIG. 7 shows the re-transfer toner amount in the case where the monochromatic 100% image (also referred to as full black image) of each color has been output when the image forming order is not changed. FIG. 8 shows the case where the image forming order is changed. As will be understood from the diagrams, the image forming order of yellow (Y), magenta (M), cyan (Cy), and black (Bk) is changed to the image forming order of cyan (Cy), magenta (M), yellow (Y), and black (Bk). By changing the image forming color order as mentioned above, the re-transfer toner amount of all colors can be set to 0.2 as a target value or less.

Although the image forming order has been determined based on the number of prints in the embodiment, if the user wants to eliminate a factor of a print size or the like, the image forming order can be also determined based on an accumulated time of the developing roller driving time from the initial using time.

Although the image forming apparatus of the intermediate transfer system has been used in the embodiment, the invention is not limited to the image forming apparatus of the intermediate transfer system but can be also constructed by a direct transfer system in which the images are directly transferred onto recording paper conveyed on a conveying belt.

Although the re-transfer toner amount has been evaluated by the reflection concentration of the adhesive tape, it can be also actually evaluated by a weight of re-transfer toner on the drum.

In the embodiment, the image forming operation has been executed in order from the developing cartridge whose accumulated number of prints as a use amount of the developing cartridge is smaller. However, it is also possible to construct in such a manner that the image forming order of the specific developing cartridge is fixed in consideration of fixing performance, mixture of the toner into the developing cartridge, and the like and the image forming order of the other developing cartridges is changed. Although the re-transfer toner amount depends on the number of prints in the embodiment, if the re-transfer toner amount differs for every color, the image forming order can be also determined in consideration of a color difference.

In the embodiment, the primary transfer current value has been set to be 8.7 μA for all colors irrespective of the using state of the developing cartridge. However, the primary transfer current value can be also set to a large value within a range where a re-transfer degree does not deteriorate largely in consideration of the case where the transfer performance deteriorates largely with an increase in the use amount of the developing cartridge.

It is also possible to switch the image forming order and change the image forming conditions according to the order change. For example, the primary transfer current value which is set after the image forming order was changed to the order of cyan (Cy), magenta (M), yellow (Y), and black (Bk) can be also set to a value different from the primary transfer current value which is set in the case of the image forming order of yellow (Y), magenta (M), cyan (Cy), and black (Bk).

Embodiment 2

The second embodiment of the image forming apparatus according to the invention will now be described. In the first embodiment, the number of prints has been used as a use amount of each developing device in order to determine the image forming order of the developing devices. If the print ratios of all of the developing devices are almost constant, a correlation is almost obtained between the decrease in external additive agent on the toner surface and the number of prints. However, the decrease in external additive agent on the toner surface is promoted with a decrease in toner amount in the developing device. This is because when the toner amount in the developing device is small, a toner circulation is smaller (a ratio at which the new toner is supplied and circulated is smaller) as compared with that in the case where the toner amount is large. Thus, the number of opportunities in which the same toner is abraded with the developing blade and the toner supplying roller increases and the decrease in external additive agent on the toner surface is promoted.

For example, the case where the images of different print ratios have been printed to every 3000 sheets will be described.

(1) The case where the image of the print ratio of 5% has been printed to 3000 sheets.

(2) The case where the image of the print ratio of 50% has been printed to 600 sheets and the image of the print ratio of 1% has been printed to the 601st to 3000th sheets.

When comparing (1) and (2), although the total numbers of prints are equal to 3000, the toner residual amounts in the developing devices at a point of time when 3000 sheets have been printed differ largely. In the case of (2), the toner residual amount in the developing cartridge at a point of time when 600 sheets have been printed is very small and the decrease in external additive agent on the toner surface is remarkably promoted by the subsequent printing.

In the embodiment, in order to cope with such a situation, a value serving as an index value of an external additive agent decrease amount A is calculated as a parameter by which the correlation with the decrease in external additive agent on the toner surface is obtained and the image forming order of the developing devices is determined by the calculated index value of the external additive agent decrease amount A.

The index value of the external additive agent decrease amount A will now be described. The decrease in external additive agent on the toner surface is promoted as the weight of toner in the developing cartridge is smaller. It is reduced as an amount of toner in the developing cartridge is larger.

The index value is the value indicating an amount of the external additive agent that may be buried under the toner and the value indicating an amount of the external additive agent may separate from the toner moreover.

According to the examination of the present inventors et al., the decrease in external additive agent on the toner surface has the large correlation with the accumulation value from the initial using time of (driving time of the developing roller)× constant T (Expression 1).

The accumulation value from the initial using time of the above value is assumed to be the index value of the external additive agent decrease amount A.

The constant T depends on the amount of toner in the developing cartridge. When the toner residual amount is small, since the decrease in external additive agent on the toner surface is promoted, the constant T is set to a large value.

In the embodiment, an amount of available toner (amount of toner enclosed in the non-using state) is equal to 300 g. FIG. 9 shows a table of the toner amount in the developing cartridge and the constant T. The detecting unit of the toner residual amount in the developing cartridge performs the successive residual amount detection of the electrostatic capacitance system. According to such a system, since the toner amount in the developing cartridge is detected by detecting electrostatic capacitances among a plurality of electrodes arranged in the developing device and this system is a well-known system, its detailed description is omitted.

As a toner residual amount detecting system, an optical detecting system for detecting the toner residual amount by using a light transmission time by a light emitting element and a photosensitive element, a torque detecting system, a pixel counting system for counting the number of pixels of the image data, or the like can be used.

The printing operation of the embodiment will be described hereinbelow with reference to FIGS. 10 and 11.

Figure 10:
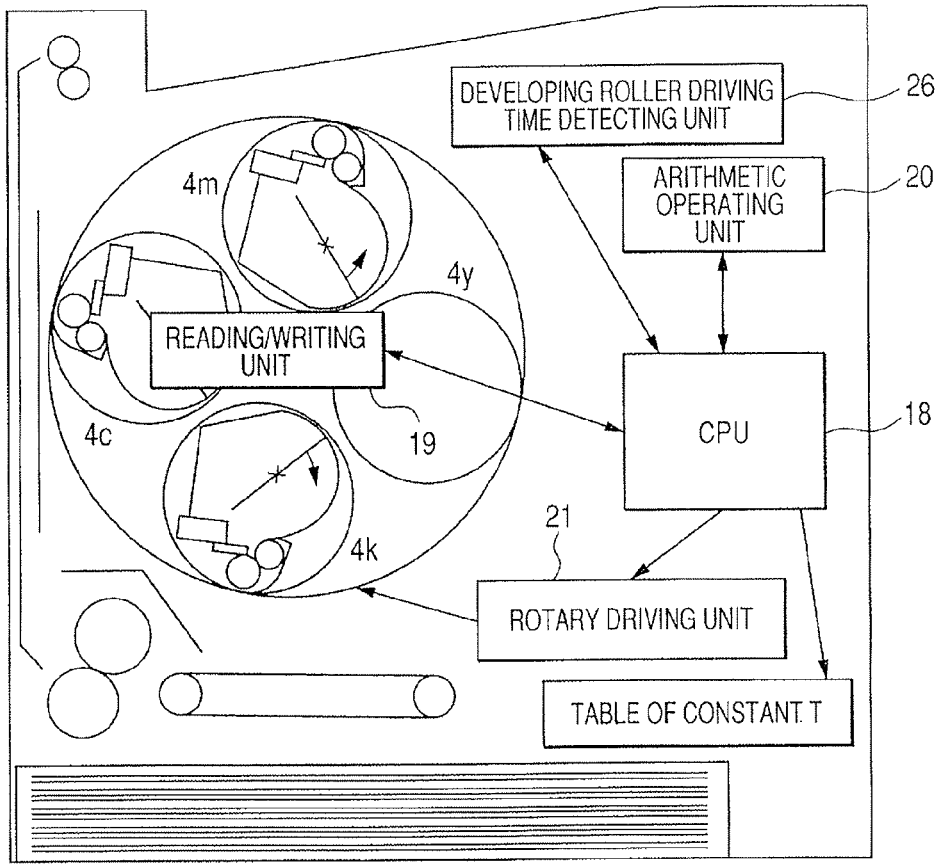
FIG. 10 is a block diagram illustrating a control system in the embodiment 2.
Figure 11:
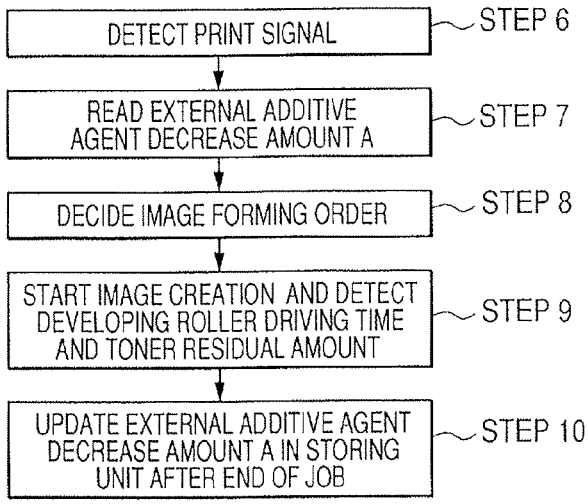
FIG. 11 is a flowchart for the printing operation in the embodiment 2.

FIG. 10 is a block diagram illustrating a control system in the embodiment 2. FIG. 11 is a flowchart for the image creation in the embodiment 2.

The image forming apparatus detects a print signal (step 6).

The CPU 18 of the image forming apparatus transfers the index value of the external additive agent decrease amount A of the developing device stored in the storing unit of the developing device from the R/W unit 19 of the image forming apparatus main body to the arithmetic operating unit 20 (step 7).

The arithmetic operating unit 20 determines the order of executing the image forming operation from the index value of the external additive agent decrease amount A read out of the storing unit of each developing device (step 8).

The CPU forms the images in the order determined by the arithmetic operating unit 20 by controlling the driving unit 21 of the rotary 5. The detection of the driving time of the developing roller is started by a developing roller driving time detecting unit 26. By rotating the photosensitive member, the image forming operation is started in the order determined in step 3. The toner residual amount is detected upon image creation (step 9).

After completion of the job, the index value of the external additive agent decrease amount A is calculated based on the Expression 1 (developing roller driving time ×T) and written into the storing unit 17 of the developing device and updated (step 10). The calculated value is added to the index value read from the storing unit 17, and the added value is written into the storing unit 17.

FIG. 12 shows the re-transfer toner amount in the case where the image forming order has been determined based on the index value of the external additive agent decrease amount A and the images have been formed when the using states (print ratios and the numbers of prints) of the developing cartridges of the respective colors are different.

FIG. 13 is a diagram showing the re-transfer toner amount in the case where the images have been formed in order of the accumulated number of prints in the using state of the developing cartridges.

When comparing FIGS. 12 and 13, it has been confirmed that according to the embodiment, by changing the image forming order according to the index value of the external additive agent decrease amount A of the developing device, the re-transfer due to the decrease in external additive agent on the toner surface can be further lightened and images of higher picture quality are formed as compared with those in the case of determining the image forming order based on the accumulated number of prints.

According to the embodiments, the images can be formed in consideration of a variation in decrease amount of the external additive agent due to differences of the print ratios among the developing devices (developing cartridges).

Although a difference due to an environment of the image forming apparatus is not considered in the embodiments, the constant T can be also changed according to not only the toner residual amount but also the environment (conditions of a temperature and a humidity) where the image forming apparatus has been set.

Also in the embodiment 2, the primary transfer current value has been set to 8.7 μA for all colors irrespective of the using state of the developing cartridge in a manner similar to the embodiment 1. However, the primary transfer current value can be also set to a large value within a range where the re-transfer degree does not deteriorate largely in consideration of the case where the transfer performance deteriorates largely with an increase in the use amount of the developing cartridge.

It is also possible to switch the image forming order and change the image forming conditions according to the order change in a manner similar to the embodiment 1. For example, the primary transfer current value which is set after the image forming order was changed to the order of cyan (Cy), magenta (M), yellow (Y), and black (Bk) can be also set to a value different from the primary transfer current value which is set in the case of the image forming order of yellow (Y), magenta (M), cyan (Cy), and black (Bk)

The image forming apparatus is a color printer which includes the rotary 5 and four developing cartridges (Y,M,C, K) attached to the rotary 5 in the embodiments. But it is not limited to the apparatus. Another image forming apparatus includes the apparatus in which four cartridges are on an outer part of the photosensitive member and the apparatus has the intermediate transfer member (this is the Four-cycle method), or the apparatus may be the apparatus of a tandem method (this is the In-line Method).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-027501, filed Feb. 3, 2006, which is hereby incorporated by reference herein in its entirety.

What is claimed is:

1. An image forming apparatus comprising:

an image bearing member onto which images are formed;

a plurality of developing devices which sequentially form images of different respective colors onto the image bearing member, and which have developers of the different respective colors;

a transfer unit which transfers the images of the different respective colors formed on the image bearing member by the plurality of developing devices onto a transfer member or a recording medium;

a detecting unit which detects a use amount of each of the plurality of developing devices every time a series of the images are formed, and determines a total use amount by adding the detected use amount to a previous total use amount of the plurality of developing devices; and a control unit which compares the total use amount of a first developing device and a second developing device of the plurality of developing devices detected by the detecting unit, and then switches the order of forming the images such that, after the one of the first and the second developing devices having a lesser total use amount forms an image, the other developing device having a greater total use amount forms an image.

2. An apparatus according to claim 1, wherein each of the plurality of developing devices includes a storing unit which stores information, and wherein the control unit stores the total use amounts of the plurality of developing devices determined by the detecting unit into the storing unit of each of the plurality of developing devices.

3. An apparatus according to claim 1, wherein each developing device includes a developer holding member which conveys the developer onto the image bearing member, and wherein the detecting unit which detects the use amount of each of the developing devices is a unit which detects the number of prints or a unit which detects a driving time of the developer holding member.

4. An apparatus according to claim 1, wherein the plurality of developing devices are developing devices which enclose the developers of yellow, magenta, cyan, and black, and the control unit switches the order of image formation by the developing devices which enclose the yellow, magenta, and cyan developers.

5. An apparatus according to claim 1, wherein the detecting unit detects an amount of the developers of each of the developing devices as the use amount.

* * * * *